US007721975B2

(12) United States Patent
Zaharis

(10) Patent No.: US 7,721,975 B2
(45) Date of Patent: May 25, 2010

(54) HEATED SALTWATER HIGHWAY DEICING MACHINE

(76) Inventor: Leon Edward Zaharis, 1398 Mecklenburg Rd., Ithaca, NY (US) 14850-9389

( * ) Notice: Subject to any disclaimer, the term of this patent is extended or adjusted under 35 U.S.C. 154(b) by 821 days.

(21) Appl. No.: 11/435,641

(22) Filed: May 17, 2006

(65) Prior Publication Data

US 2007/0221749 A1 Sep. 27, 2007

Related U.S. Application Data

(60) Provisional application No. 60/785,934, filed on Mar. 24, 2006.

(51) Int. Cl.
*A01G 25/09* (2006.01)
*B05B 1/20* (2006.01)

(52) U.S. Cl. ..... 239/1; 239/155; 239/159; 239/172; 239/132.1; 239/128; 239/332

(58) Field of Classification Search ..... 239/650–689, 239/1, 155, 159, 172, 332, 337, 128, 132.1; 37/277, 278

See application file for complete search history.

(56) References Cited

U.S. PATENT DOCUMENTS 2,681,828 A * 6/1954 Pollard ..... 134/5
6,446,879 B1 * 9/2002 Kime ..... 239/7

* cited by examiner

*Primary Examiner*—Dinh Q Nguyen

(57) ABSTRACT

My invention is different in that it uses high temperature water to dissolve either evaporated granular salt, evaporated salt blocks, evaporated salt buttons, solar salt blocks, bulk or bagged solar salt crystals, or halite rock salt crystals to create a highly saturated, highly concentrated salt brine with or without adjuncts such as waste beet juice, molasses, calcium chloride, magnesium chloride to deice streets, roads, bridges, highways, sidewalks, curb cuts, building entrance steps, and airport runways and airplane taxi ways leading to airport runways. The use of the heated salt brine and adjuncts such as waste beet juice or molasses will prevent the solution from being diluted by holding it place with the sucrose or fructose based molasses used to bind the brine to the surface requiring deicing. The use of calcium chloride and magnesium chloride as adjuncts will increase the heated salt brine's effectiveness at lower temperatures.

1 Claim, 3 Drawing Sheets

HEATED SALTWATER HIGHWAY DEICING MACHINE

INCORPORATION-BY-REFERENCE OF MATERIAL SUBMITTED ON A COMPACT DISC

Not applicable.

BACKGROUND OF THE INVENTION (1) Field of the Invention

This application is entitled to the benefit of Provisional Patent Application Ser. No. 60/785,934 filed Mar. 24, 2006. This invention deals specifically with improving deicing and snow removal on highways, bridges, roads and streets.

(2) Description of Related Art Including Information Disclosed Under 37 CFR. 1.97 and 1.98

The extensive use of rock salt for highway deicing did not begin until the United States had a system of paved roads due to the introduction of the automobile as a method of transportation from place to place. Sand was used as a traction aid on city streets, hills and highways when ice was encountered. The sand was left to sit on the roadway and provide a surface for the automobile tires to grip upon for proper traction of the automobile, delivery truck, ambulance, police car or fire truck etc. The sand remained on the roadway until the snow and ice melted in the spring, and in the cities it filled the storm sewer catch basins and the catch basins would overflow due to the build up of trash, sand and leaves in the catch basins. Municipalities using the combined sewers used by many municipalities required frequent cleaning due to the build up of sand in the sewer pipes if they did not use catch basins. This job required many man hours of labor to shovel out the storm sewer catch basins, and cleaning the sewer pipes with cleaning buckets attached to winch cables at the street level. With the introduction of vacuum sewer cleaning trucks and high pressure water jet cleaners the job of cleaning both the combined sewers and separate sanitary sewer systems became easier and require less manual labor. The introduction and use of solar and rock salt to deice the streets hills and highways eliminated the need for sand as a traction aid for motor vehicles as the salt melted the snow and ice and was inexpensive to use for deicing and snow removal. The use of rock salt and solar salt eliminated the need for sanding the streets and the required cleaning of the storm sewer catch basins of sand deposited there by water run off from the street. Many municipalities simply used either solar salt or rock salt to remove ice and snow, and only plowed when it was required due to the weather conditions as the use of salt for deicing was much less expensive to use as it left no residue to be cleaned up every spring. As a result of heavy salt use the diluted salt water gradually makes its way into the surface water of rivers and streams and it also penetrates to some sources of ground water rendering it unusable unless it is pumped through a reverse osmosis filtration system. The surface water pollution from deicing salts and chemicals is a subject of increasing concern and increased regulation in regard to allowable discharges of salt water from storage piles and salt sheds.

The Salt Institute data for the tonnage sold of rock salt referred to as Halite in the year 2008 was 22,185,000 tons, this amount does not include the amount of solar salt sold for highway deicing.

The use of deep mined rock salt referred to as Halite and solar evaporated salt requires intensive use of different types mining machinery using high voltage electricity and diesel fuel to provide power to the machinery and human labor to operate the mining machinery.

In the case of deep mined rock salt the salt is mined by rubber tired mobile diesel and electric mining machinery used in room and pillar mining in several areas of Canada, The United States, South America, and European Union to provide halite for deicing roads and highways. The deep mining of Halite requires the use of explosives being typically ANFO being ammonium nitrate fertilizer mixed with diesel fuel to act as a combustion accelerant due to its ease of use low cost, and explosive energy output.

In Chile, South America, Halite is mined in strip mining fashion using high explosive ANFO and surface mining drills and as it is exposed on the surface of the earth in several very thick dry exposed salt lake bed deposits in the Andes Mountains. Halite is also deep mined in Columbia as well using room and pillar mining methods.

Solar evaporated salt is harvested using tracked or wheeled harvesting machines with mining heads mounted under the frames which break the solar salt from the floor of the final salt concentrating pond where it is harvested. The salt is loaded into trucks for delivery to the screening and crushing plant where it is washed with salt water. It is dried in a rotary kiln, screened, and crushed to useable sizes for the various markets including those of human consumption for table salt, pressed in to salt blocks for livestock use and fish packing houses served by the solar salt company and deicing salt as well. Solar salt is also highly recommended for water softening due to its purity and high salt concentration.

Many millions of tons of deep rock salt are used for highway deicing. This requires massive amounts of diesel fuel to mine and store it at mine based stock piles. To transport it by rail and barge to distant stock piles, and much more diesel fuel, labor and equipment cost to stockpile it at the end users location, and it also requires extensive use of pollution control methods to control salt water run off. The use of rock salt requires additional diesel fuel and labor to transport it, spread it, and repeat the process to keep the highways clear of ice and snow. Most if not all states or nations in the snow belts have a bare roads policy to allow safe and swift travel from place to place in the northern latitudes of the United States, Canada and the European Union.

Salt used for deicing is transported from a storage stock pile to the end user and dumped at the local highway department salt storage shed. The salt is pushed or conveyed to the stock pile and then removed by a front end loader, and dumped into salt spreaders for ice and snow control on roadways and streets.

Some municipalities have overhead storage silos that allow for vertical storage of the rock salt thereby reducing the space needed to store it and the potential pollution run off. The rock salt is blown into these silos using a pneumatic bulk truck trailer system of delivery which uses a very low pressure, high volume air stream delivery method to blow the halite salt crystals to the top of the silo for storage. Gravity is used to fill the salt spreaders rather than a front end loader in this case saving time, labor, and reducing salt waste from spillage due to over filling a salt spreader.

Pollution from rock salt storage is a major issue requiring the construction of approved salt storage sheds to contain the salt and reduce salt water run off by diverting rainwater away from the storage shed. Salt stock piles are required to have gutters to collect rainwater falling on covered salt piles and under surface conveyors to collect any rainwater run off into collection ponds which will contain and manage the salt water volumes. The waste salt water is required to be filtered using reverse osmosis to cleanse it of salt and allow the clean water to be discharged safely to comply with existing water pollution regulations.

Most large municipalities are required to store rock salt in huge storage barns, which can store a large amount of salt in a barn or igloo structure.

The rock salt is typically conveyed into a storage igloo by a conveyor belt at the top or if the igloo is a large structure it is pushed up into a pile making a road in the salt pile with a wheel loader.

Large users of deicing salt do not store an entire season's worth of deicing salt as they are unsure how much salt they may need in a typical year. They purchase only the salt they need on an "as needed" basis to fill the salt barns as they use it maintaining a few weeks supply of deicing salt.

The states and municipalities have guarantees written into the salt sales contracts with the deicing salt. As deicing salt providers that they must be able to provide 25 percent more deicing salt than of the agreed upon amount in the salt allocation in the bidding process to guarantee a continuous supply at that same price in the event of a severe winter season. This is a typical contract condition for awarding a salt bid contract to the low bidder during the bidding period award to the successful salt provider.

Many but not all municipalities participate as buyers of halite with the state purchasing agency acting as the principal in the purchase of halite this allows the smaller municipalities to pay the same price for halite as the state pays and save tax dollars and nearly eliminate possible shortages.

Some of the smaller municipalities do not buy a lot of deicing salt and are forced to buy it at the market price during the salt season. The seasonally spot prices paid for deicing salt per ton can increase substantially in cost per ton during a year when there is little local salt to be purchased, unless a purchaser is a guaranteed recipient of deicing salt due to the mandatory salt allocation process. If more salt is required an end user may pay much more to have additional salt brought in from another location if needed. This happens to small plowing contractors every year in a bad winter season with above average snow and ice conditions.

This has pressured some users of straight deicing salt to use sand again for their highways as they are unable to obtain normal amounts deicing salt to maintain their roads and streets due to price increases for halite. This past year many municipalities in New York State have returned to using more sand on their roads and streets. This is due to the high cost of deicing salt which is the result of higher production costs due to increased diesel fuel costs and higher natural gas costs which is used to make the ammonium nitrate fertilizer used as an explosive agent to mine the rock salt. This has also forced the price of sand to increase as well due to the increased demand for salting sand which is the sand that is used when formulating concrete mixes. The resulting reduction in salt water pollution of fresh water streams and bodies of water helps the local environment to recover quickly as the salt is much less concentrated and dilutes to smaller concentrations.

The typical sand and gravel plant is shut down in the wintertime due to the reduced demand for their products. As these plants use water to wash the sand from the gravel it will freeze unless the screening plant is using a non toxic antifreeze or is in a heated building.

The price hikes involving sand are due to a municipality not owning a sand and gravel screening plant of its own to make its own crushed stone gravels, and in the process of screening and crushing bank run gravels to obtain washed sand for traction grit on its roads. As a result they must purchase sand from a local sand and gravel pit that may be locally owned or owned by an outside corporation.

Salting sand and sand mixed with calcium is typically mixed by a front end loader mixing the two components together to make a useable percentage of salting sand to stretch out both the salt and sand supply during the winter season.

Some municipal users have trucks that simply spread salt during the winter months or dual use trucks which have both snow plow and salt spreader mounted to a truck body.

The City of New York, N.Y. has snow plows mounted on many of its individual garbage trucks plowing snow as they collect refuse on its streets in the five boroughs. The trucks owned by smaller municipalities and used for deicing and snow removal have other duties such as ditch digging and cleaning ditches. These trucks may have up to 4 drive axles, and may also be equipped with all wheel drive depending upon the location and severity of a typical winter in that area.

The various states and municipalities that use salt for deicing have preset minimum salt use levels referred to as pounds per lane mile to deice highways per the various states department of transportation and its recommendation for salt coverage on its roads. In my home state of New York Halite is spread at a minimum of two hundred pounds per lane mile depending upon road conditions. This means that four hundred pounds of salt will be spread per mile of two lane roadway. This is accomplished using metering wheels in contact with the road surface or a milage counter in the truck cab used in conjunction with a Global Positioning System and a vehicle speed determination wheel in contact with one of the rear truck tires.

Due to Halite and other deicing products increasing expense due to increasing labor costs and costs of production and transportation inventors created several types of salt metering methods and salt pretreatment systems to improve its effectiveness and to reduce its overall cost to the end user being a municipality. These methods include lane mile counters and metering devices to properly dispense deicing salts and the various chemicals used for deicing highways, roads, streets and bridges.

U.S. Pat. No. 2,681,828 06-1954 classification 134/5 to Pollard, discloses a method of highway deicing using a vehicle mounted steam energy delivery system in a very large and complex plumbing arrangement used heat brines prior to pumping them to the deicing spray nozzles, and then upon the road surface using a trailer vehicle in combination with a towing vehicle.

(a) The use of steam energy in a road vehicle is dangerous simply due to the risk of a steam explosion and its potential for property damage and injury and death to persons in vehicles passing the deicing unit and any nearby pedestrians in a municipal location.

(b) The use of a steam generating boiler also requires the annual testing and inspection of the steam vessel for its continued safe use as a steam vessel as required by local fire and plumbing safety codes.

(c) The cost of making massive amounts of steam to heat brine as it is dispensed is prohibitive as the steam is not recovered for reuse and will be subject to price hikes of oil fuels during the winter season.

U.S. Pat. No. 6,446,879 09-2002 classification 239/7 to Kime, James A. discloses a method and apparatus depositing snow-ice treatment material on pavement using a dump truck body, twin augers mounted in the dump truck body for metering salt to a mixing box and then to a cross auger which delivers salt to both sides of the vehicle to gravity drop tubes where the salt impacts a spinning mechanism to spread the deicing salt, and deposits it in narrow bands between the left and right rear wheel sets of the delivery truck while they are pre wetted in the movement of the vehicle and pushing the wet salt crystals under the tires with the weight of the vehicle upon the road surface. The deicing method utilizes a low voltage control system to operate the dump bed, the salt crystal delivery augers in the dump bed, the cross flow auger that delivers salt to the drop tubes under the truck body, the hydraulic power system, and the plowing blade and brine water delivery system.

Thus if the Kime deicer is implemented for use, the vehicle must be used for the sole purpose of deicing streets and roads and limits its availability to the owner of the vehicle until and unless the deicing machineries are completely removed from the transport vehicle and another dumping body must be installed to facilitate its use as a dump truck.

(d) The complete removal of a deicing mechanism of this type and replacing it with a dumping body requires many hours of manual labor and the use of an overhead bridge crane in a highway maintenance truck repair shop.

(e) Many highway departments do not own bridge cranes and often use a front end loader or large forklift to remove and install the various truck bodies they must use outside the repair shop in an open area to allow movement of the machine used for lifting the detached body from the truck frame with considerable risk of injury to an employee supervising the removal of the truck attachment from a possible broken lift chain, wire rope or fabric sling used to lift the deicing mechanism. The deicing mechanism must also be drained, physically cleaned and washed to remove built up salt deposits every day as well which will reduce its effectiveness as delivery mechanism.

(f) The deicing system wiring and controls will have to be removed at the end of every snow season and the wiring will be subject to salt corrosion and ice damage due to ice clinging to the wiring and breakage of the wiring due to ice buildup. Ice and snow will build up upon the truck body as well simply due to the natural excess moisture in a Snow Belt area, and due the heat generated by the vehicle itself attracting excess moisture. Many municipalities are required to use their truck fleet the year round due to a small vehicle fleet. This requires changing many truck bodies twice each year, once for the snow season and the second time for the spring summer and fall seasons which takes many hours of valuable labor which could be used elsewhere. The fact that many snow removal vehicles are left out of doors due to the physical size of the front plows and wing plows attached to the vehicle which reduces available overhead door side clearances in many municipal truck shops.

(g) The truck mounted snowplows and salt spreaders are left out of doors in the off season as they are not stored indoors due to available space limitations. The plows and salt spreaders are exposed to the elements and are allowed to rust during the off season months, and when the time comes to remount the plows and spreaders considerable time is spent cleaning the mounting pins for the snow plows, replacing the plow cutting edges and removing rust from the plow mounting frames on the plow trucks to mount the front plows and wing plows. Any bad wiring encountered must be replaced with individual repairs or new wiring harnesses if so equipped by the manufacturer of the salt spreader.

(g) The overnight exposure to the elements of highway plows and deicing machinery is a major problem for many small municipalities as it reduces the useable life span of a vehicle for the municipality. Many municipalities store the salt spreading bodies out of doors during the warm months of the year as they do not have the room or feel it is necessary to store them indoors and as a result the remaining salt if any is a magnet for moisture.

(h) The truck with the salt and sand spreader is backed under a steel or wood frame structure with no roof, and the spreader is physically hoisted off the truck body with chain hoists at each corner when it is determined that the snow season has ended, and they are left hanging until it is time to install them in the beginning of the winter season on a dump truck. The dump truck bodies are usually removed and set upon a number of empty oil barrels in a storage yard and left outdoors on the ground until they are needed again in the early spring. This also subjects them to the elements and corrosion.

(i) Several manufacturers of salt/sand spreaders are manufacturing spreaders that are simply placed in the dump body of a dump truck minus the tailgate of the dump truck and chained into place eliminating the need to remove the dump body of the dump truck.

The hydraulic and low voltage controls are routed through the frame of the truck to the salt spreader and reconnected to it for its use during the winter season. Many manufacturers of salt and sand spreaders are using stainless steel in the construction of the their spreaders due to salt corrosion and the spreaders being left out of doors. The use of stainless steel is a benefit as far as corrosion resistance but the stainless salt spreaders are more expensive to purchase initially but will have a longer life span.

(j) Salt and sand spreaders are either equipped with a conveyor belt or drag chain to deliver the deicing chemical and drops down to the spinner mechanism that ejects the salt or sand on the road behind the truck and onto the road way, these spinners are typically powered by a hydraulic motor controlled in the truck cab by the driver or the computer used to control the salt spreader operation.

(k) If the truck driver is driving too fast quite often the salt bounces off the road way and into the ditch. This happens quite often in good driving conditions with dry pavement at faster driving speeds, and on the thin layers of ice left after plowing as the salt crystals cannot stick to the ice, and bounce off the road surface into the road ditch or street gutter unused for deicing the roadway or street. This past winter of 2008-09 has seen huge price increases for deicing salt due to the higher than average use of salt for deicing and the increases in the cost for mining the salt for sale to the municipalities and other smaller users of salt for deicing. The massive deicing salt price hikes are common in years with bad weather for the entire season. The end users have consumed all the available salt and have to wait for more to be delivered due to the weather extremes requiring the use of more deicing salt in stockpiles which are a normally part of the annual salt inventory for an average year. The deicing salt is used and melts away in to the surface water runoff never to be used again.

BRIEF SUMMARY OF THE INVENTION

My patent invention utilizes a high temperature salt brine delivery method that is fifty or more times as salty as sea water to deice highways using much less salt in a brine form than is required using the current methods of dispensing deicing salt crystals with or with out adjuncts such as molasses or waste beet juice. The use of adjuncts such as waste beet juice and or molasses will hold the deicing brine in place as it is sprayed on to the surface to be cleared of ice and snow and will not be rinsed away and lost as the waste beet juice or molasses will stay in place due to its sugar content as it is a very sticky substance. The highly saturated salt brine will be delivered in a much smaller volume to reduce run off and salt water pollution.

Figure 1:
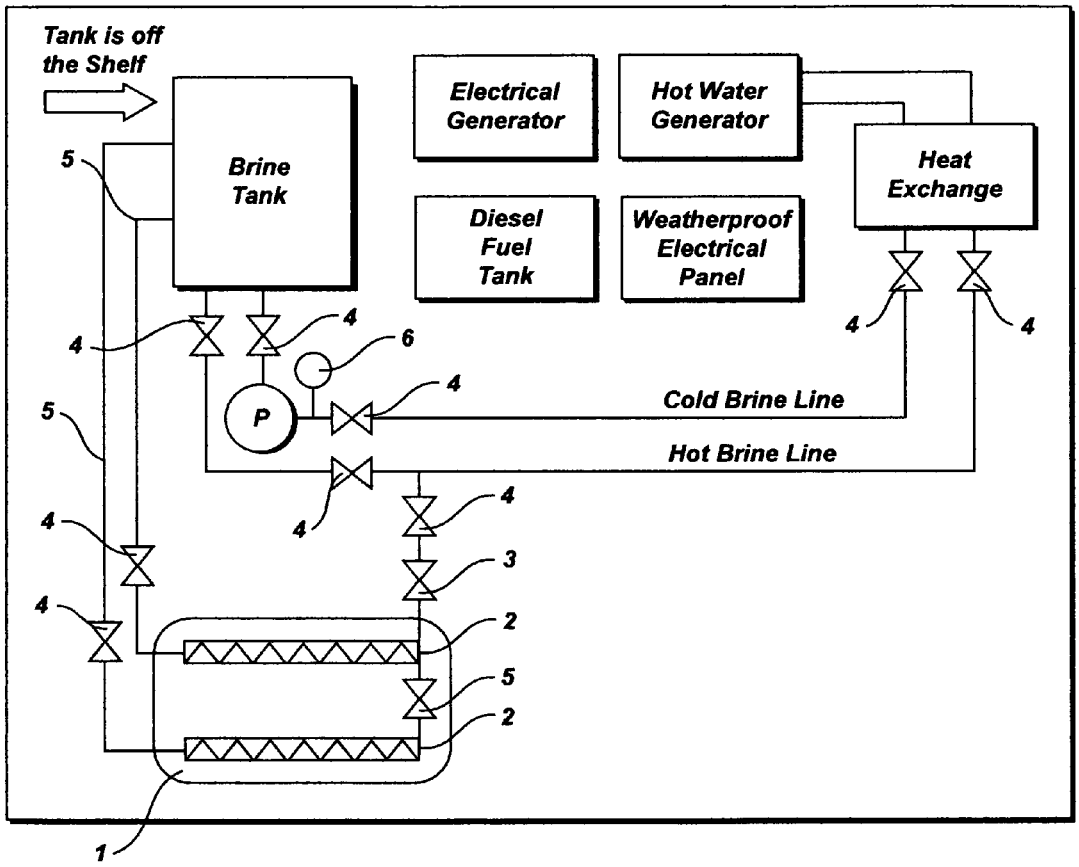
FIG. 1 is the top view of the deicing system in its entirety minus the mounting skid, which will hold the all the parts visible to the reader in the drawing, the drawing is a basic flow diagram for heated brine delivery and control of the brine system. The top view shows the entire deicing machine with all components visible with no hidden objects. The system design and layout is simple and linear allowing easy maintenance of the deicing unit and servicing of the unit with common plumbing parts available locally. The spray nozzles are of a low flow design to allow a reduced volume of brine to be delivered to the roadway in a very controlled manner and volume of delivery versus salt crystals bouncing everywhere on the road way. The use of waste beet juice and or molasses ensures the brine will not wash away as well. The item labeled brine tank in figure one is the tank used to hold salt used to make the hot saline brine and also act as a mixing and recirculating tank to maintain the mixture in suspension for spraying upon the road surface. The item labeled electrical generator provides both 120 volt and 240 volt alternating current electric power to the highway deicing units pump and solenoids valves used to deliver the heated brine to the spray nozzles and allow heating and the recirculation of the brine to maintain the brines high temperature. The fuel used for the generator is diesel fuel. The item labeled hot water generator heats and reheats the brine solution. The fuel used for the hot water generator is diesel fuel. The item labeled diesel fuel tank is the fuel storage tank used to refuel the hot water generator and electric generator used to power the entire deicing unit. The item labeled electrical panel is the wiring and control center for the deicing system and the tethered remote control in the truck cabin. It consists of a weather and waterproof electrical box and circuit breakers ment for use in wet environments, a main circuit breaker to safely operate the electrical system used to control the delivery of electricity to the hot water generator, the pump for the system, which is labeled as the letter P and the solenoid valves, which drive flow to the two spray booms labeled number 2 which turn the brine flow and pump system flow on or off. A common waterproof on off switch that is used in the truck cabin is used to control the pump and the electric solenoids directing the heated brine flow to the spray booms. The item labeled heat exchanger is where the heating brine solution is pumped from the hot water generator exchanges its heat with the salt water brine solution to heat and reheat the brine solution to maintain a properly mixed hot brine solution. The item labeled 1 is the curtain of either canvas fabric or used conveyor belt to contain any salt spray drift to eliminating any waste and over spray. The items labeled 2 are the two Spray booms to deliver the heated brine solution to the roadway. The items labeled 3 are the low voltage solenoid valves used to control and direct the hot brine flow to the spray booms or allow its recirculation. The items labeled 4 are the manually operated stainless steel ball valves used to shut off the flow of hot brine from the brine tank, the heat exchanger and the spray booms. The items labeled 5 are the two one half inch national pipe thread stainless steel return lines to the brine tank to return unused brine back to the brine mixing tank for reheating and reuse. The item labeled 6 in the drawing is the bladder tank used to regulate the heated brine delivery system pressure to the spray booms. The items labeled 7 in the drawing and listed as the cold brine line and hot brine line are one half inch national pipe thread stainless steel pipe used in the recirculation and heated brine delivery to the tank and spray booms. The item labeled eight is a low pressure hose reel allowing the delivery of the heated brine solution through the item labeled 9 being a spray nozzle to deliver the heated brine to areas not easily accessible to the deicing vehicle such as sidewalks, stairs, alleyways, and curb cuts at street intersections used by both pedestrians and individuals confined to wheel chairs to make them ice free and safe for the public to use.
Figure 2:
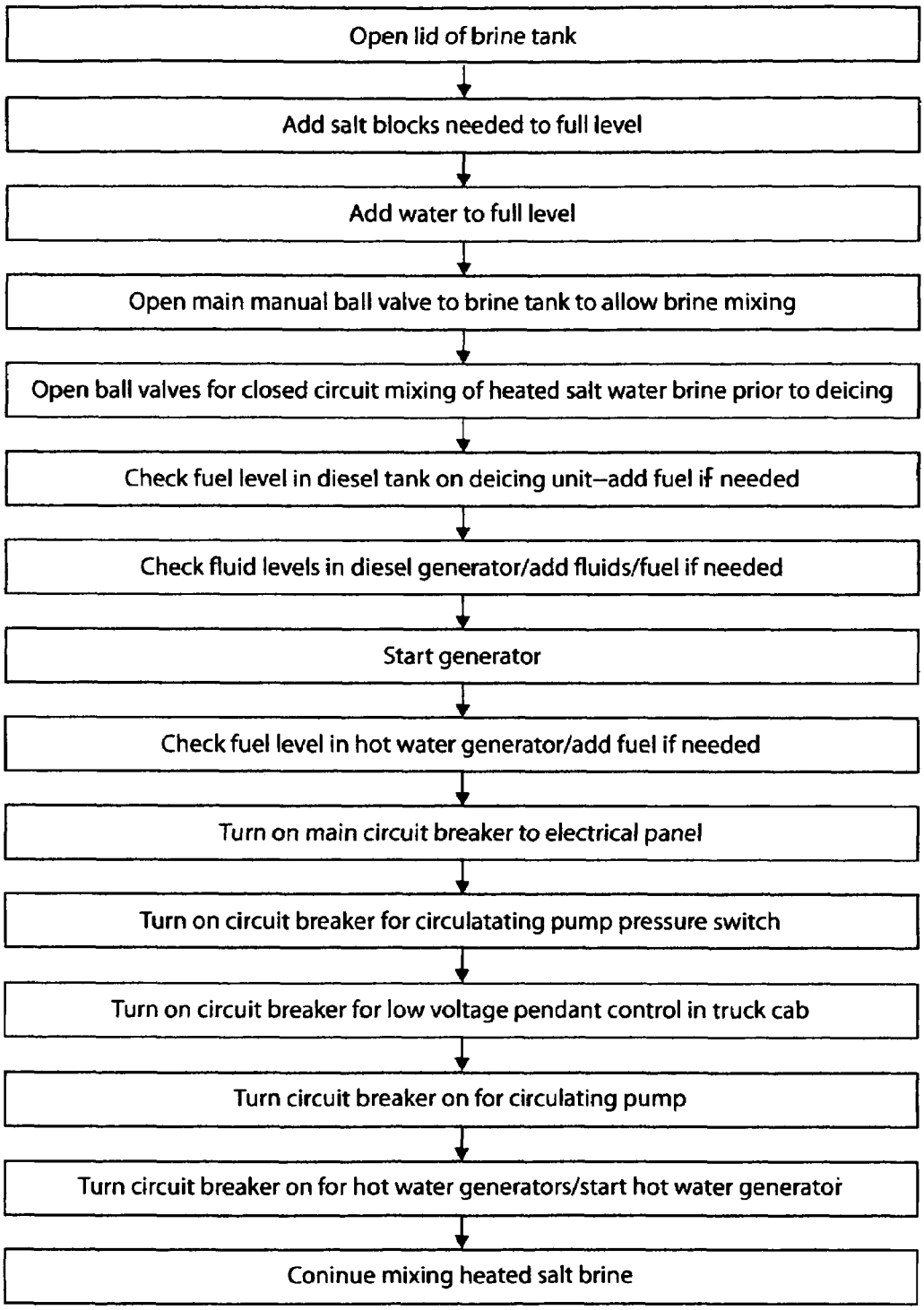

The drawing in FIG. 2 describes the proper procedure and the numerous steps required to operate the heated salt water highway deicing machine.

Figure 3:
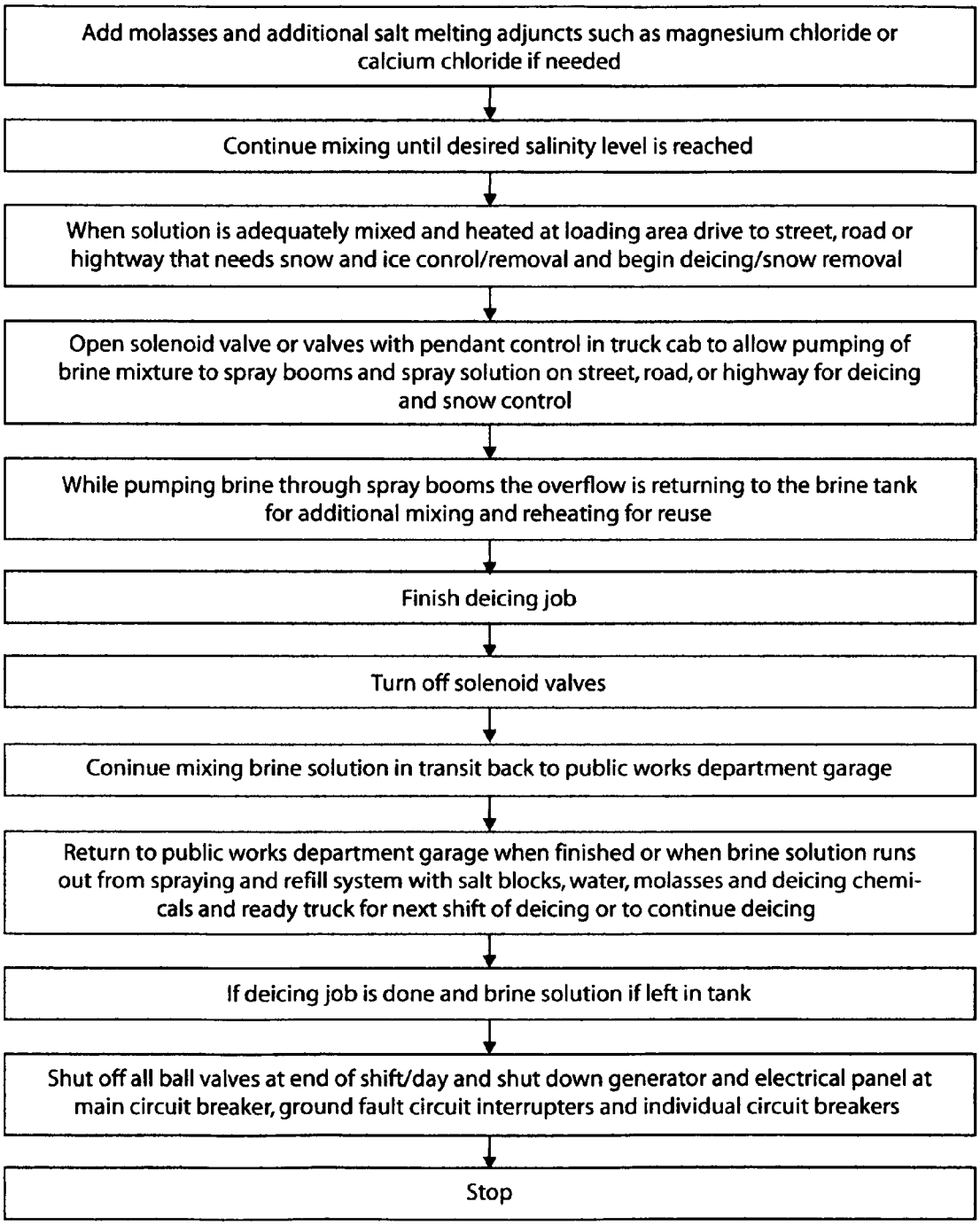

The drawing in FIG. 3 continues to describe the remaining steps required to operate the heated salt water deicing machine and the steps required to stop the deicing process and safely shut down the operation of the heated salt water deicing machine in the correct sequence for the heated salt water highway deicing machine when the deicing operation is completed.

DETAILED DESCRIPTION OF THE INVENTION

The brine tank is loaded with solar salt or another salt of high purity and an amount of water are added to the brine tank prior to starting the circulating pump and hot water generator. The generator is fueled up and the engine oil level of the generator is checked to maintain the proper level. The generator is started and the power cable from the weatherproof electrical panel is plugged into the generators electrical panel to provide power to the electrical system. The circulating pump is turned on and begins circulating water through the hot water generator. The fuel level in the hot water generator is checked and the fuel level is topped off to the full level. The hot water Generator is plugged into the weather proof electrical panel via its water proof electrical plug at the water proof receptacle in the weather proof electrical panel and turned on to start making the hot brine mixture. Water and salt using solar salt blocks or bulk solar salt is added, and continually mixed and heated by the deicing unit until the desired highly saturated brine mixture being fifty times or greater than sea water salinity is achieved by determining the brine solution with use of a saline refractometer. The waste beet juice or molasses and any other desired deicing chemical is added at this time and is continually mixed. Prior to leaving to spread the deicing solution the truck driver activates the control solenoids to ensure proper delivery of the brine mixture to the spray booms and nozzles. After he or she insures the system is working the truck driver drives to the area needing deicing and activates the pump system and solenoids to spray the brine mixture on the road surface to deice the highway. After the highway has be cleaned of ice and snow the driver returns to refill the deicing unit with salt, waste beet juice, molasses and other deicing adjuncts if desired and adding diesel fuel for the electrical generator and hot water generator for the next trip by the highway crew or crews. The highway deicing unit can also pre mix a heavy brine solution with adjuncts to be used as a nurse tank system as well saving time by making the heavy brine in the off season or during warm warmer winter weather using the same machine with ease by using a transfer pump to move the mixed brine to an indoor storage tank. A common small diameter jet spray nozzle is used to deliver the brine mixture to the road surface insuring a non plugging nozzle system for bring delivery as well The advantages to using the above heated brine system patent are the simple design that allows easy repairs if needed with easily obtainable parts. The plumbing is not as complicated as the Pollard patents plumbing. The brine flow pattern is easily reversed if desired. The deicing unit is not difficult to use for its stated purpose due to its simplicity in construction and design where anyone who can read and write can understand how to operate it efficiently and maintain it as well The deicing system does not require the interface control of an onboard computer system as the Kime patent does due to the spray nozzles measured amount of brine delivery. The system can be mounted in its entirety in the back of a dump truck with out removing the dump box or it can be mounted on a bull dozer trailer and towed by a plow truck or a road grader to deice highways and streets. The system will last for many years requiring little maintenance by simply rinsing the delivery lines pump solenoids and heat exchanger with plain hot water and cleaning the exterior of any salt build up if any.

I claim:

1. A method of deicing surfaces of highways using hot saturated salt brine comprising:

(a) placing salt blocks and water into an emptied brine tank;

(b) generating hot brine by:

i) starting a 220 volts electrical generator to generate an electrical voltage and connecting the voltage from the generator to an oil burner located at a hot water generator to heat water within the hot water generator, wherein the voltage supplying to the oil burner is reduced to 110 volts from the 220 volts generator;

ii) energizing a low voltage pendant remote control to control solenoid valves and a 220 volts hot water circulation pump;

iii) initializing voltage from the 220 volts electrical generator to the 220 volts hot water circulation pump to circulate water from the brine tank to the hot water generator and hot water from the hot water generator to a heat exchanger and the brine tank; wherein the circulating water is circulated via a plurality of half inch inside diameter stainless steel pipes;

iv) mixing the salt and water within the brine tank with the hot water from the hot water generator until all the salt blocks are dissolved;

v) adding molasses and magnesium chloride to the brine tank;

vi) placing additional salt and water to the brine tank to maintain the brine tank at a full level;

(c) supplying diesel fuel to a fuel tank located at the hot water generator and a fuel tank located at the 220 volts electrical generator;

(d) regulating pressure of the circulating water with a bladder tank;

(e) controlling the hot brine delivery rate to a spray boom with a plurality of half inch inside diameter low voltage solenoid valves (f) controlling hot brine delivery to the 220 volts circulation pump, brine tank and the spray boom with a plurality of half inch inside diameter stainless steel ball valves;

(g) spraying hot brine to surfaces of highways with a plurality of half inch pipe thread stainless steel jet spray nozzles that are attached to the spray boom;

(h) supplying hot brine to a hose reel system to spray hard to reach areas;

(i) preventing spray drifting at the spray boom with a curtain surrounding the spray booms, wherein the curtain consisting of either burlap material or a used conveyor belt;

(j) providing a circuit breaker panel for controlling of the 220 volts voltage to the circulating pumps, the hot water generator, and a float switch in the brine tank;

(k) weatherproofing an electrical panel that contains electrical connections for the hot water generator and circulating pump; and (l) controlling pressure of the hot brine that is being delivered to the spray nozzles that are located at the spray boom with a pressure control switch.

* * * * *